US007853452B2

(12) United States Patent
Gleason et al.

(10) Patent No.: US 7,853,452 B2
(45) Date of Patent: Dec. 14, 2010

(54) INTERACTIVE DEBUGGING AND TUNING OF METHODS FOR CTTS VOICE BUILDING

(75) Inventors: Philip Gleason, Boca Raton, FL (US); Maria E. Smith, Davie, FL (US); Mahesh Viswanathan, Yorktown Heights, NY (US); Jie Zeng, Miami, FL (US)

(73) Assignee: Nuance Communications, Inc., Burlington, MA (US)

( * ) Notice: Subject to any disclaimer, the term of this patent is extended or adjusted under 35 U.S.C. 154(b) by 99 days.

(21) Appl. No.: 12/327,579

(22) Filed: Dec. 3, 2008

(65) Prior Publication Data

US 2009/0083037 A1 Mar. 26, 2009

Related U.S. Application Data

(63) Continuation of application No. 10/688,041, filed on Oct. 17, 2003, now Pat. No. 7,487,092.

(51) Int. Cl.
*G10L 13/06* (2006.01)

(52) U.S. Cl. ..... 704/260; 704/258; 704/270.1

(58) Field of Classification Search ..... 704/258, 704/260, 270.1

See application file for complete search history.

(56) References Cited

U.S. PATENT DOCUMENTS

| | | | | |
|---|---|---|---|---|
| 4,831,654 | A | 5/1989 | Dick | |
| 5,617,507 | A * | 4/1997 | Lee et al. | 704/200 |
| 5,740,320 | A * | 4/1998 | Itoh | 704/267 |
| 5,774,854 | A | 6/1998 | Sharman | |
| 5,842,167 | A | 11/1998 | Miyatake et al. | |
| 5,864,814 | A | 1/1999 | Yamazaki | |
| 5,875,427 | A | 2/1999 | Yamazaki | |
| 5,913,193 | A * | 6/1999 | Huang et al. | 704/258 |
| 5,970,453 | A | 10/1999 | Sharman | |
| 6,088,673 | A | 7/2000 | Lee et al. | |
| 6,101,470 | A | 8/2000 | Eide et al. | |
| 6,141,642 | A | 10/2000 | Oh | |
| 6,366,883 | B1 | 4/2002 | Campbell et al. | |
| 6,591,240 | B1 * | 7/2003 | Abe | 704/278 |
| 7,260,533 | B2 * | 8/2007 | Kamanaka | 704/260 |
| 7,487,092 | B2 * | 2/2009 | Gleason et al. | 704/260 |
| 7,689,421 | B2 * | 3/2010 | Li et al. | 704/260 |
| 2003/0074196 | A1 * | 4/2003 | Kamanaka | 704/260 |

OTHER PUBLICATIONS

"Method for Text Annotation Play Utilizing a Multiplicity of Voices", IBM Technical Disclosure Bulletin, vol. 36, No. 06B, Jun. 1993.

* cited by examiner

*Primary Examiner*—Vijay B Chawan
(74) *Attorney, Agent, or Firm*—Wolf, Greenfield & Sacks, P.C.

(57) ABSTRACT

A method, a system, and an apparatus for identifying and correcting sources of problems in synthesized speech which is generated using a concatenative text-to-speech (CTTS) technique. The method can include the step of displaying a waveform corresponding to synthesized speech generated from concatenated phonetic units. The synthesized speech can be generated from text input received from a user. The method further can include the step of displaying parameters corresponding to at least one of the phonetic units. The method can include the step of displaying the original recordings containing selected phonetic units. An editing input can be received from the user and the parameters can be adjusted in accordance with the editing input.

7 Claims, 3 Drawing Sheets

INTERACTIVE DEBUGGING AND TUNING OF METHODS FOR CTTS VOICE BUILDING

CROSS REFERENCE TO RELATED APPLICATIONS

This application is a continuation of, and accordingly claims the benefit from, U.S. patent application Ser. No. 10/688,041 now issued U.S. Pat. No. 7,487,092, which was filed in the U.S. Patent and Trademark Office on Oct. 17, 2003, which is herein incorporated by reference in its entirety.

BACKGROUND OF THE INVENTION

1. Technical Field

This invention relates to the field of speech synthesis, and more particularly to debugging and tuning of synthesized speech.

2. Description of the Related Art

Synthetic speech generation via text-to-speech (TTS) applications is a critical facet of any human-computer interface that utilizes speech technology. One predominant technology for generating synthetic speech is a data-driven approach which splices samples of actual human speech together to form a desired TTS output. This splicing technique for generating TTS output can be referred to as a concatenative text-to-speech (CTTS) technique.

CTTS techniques require a set of phonetic units that can be spliced together to form TTS output. A phonetic unit can be a recording of a portion of any defined speech segment, such as a phoneme, a sub-phoneme, an allophone, a syllable, a word, a portion of a word, or a plurality of words. A large sample of human speech called a TTS speech corpus can be used to derive the phonetic units that form a TTS voice. Due to the large quantity of phonetic units involved, automatic methods are typically employed to segment the TTS speech corpus into a multitude of labeled phonetic units. A build of the phonetic data store can produce the TTS voice. Each TTS voice has acoustic characteristics of a particular human speaker from which the TTS voice was generated.

A TTS voice is built by having a speaker read a pre-defined text. The most basic task of building the TTS voice is computing the precise alignment between the sounds produced by the speaker and the text that was read. At a very simplistic level, the concept is that once a large database of sounds is tagged with phone labels, the correct sound for any text can be found during synthesis. Automatic methods exist for performing the CTTS technique using the phonetic data. However, considerable effort is required to debug and tune the voices generated. Typical problems when synthesizing with a newly built TTS voices include incorrect phonetic alignments, incorrect pronunciations, spectral discontinuities, unnatural prosody and poor recording audio quality in the pre-recorded segments. These deficiencies can result in poor quality synthesized speech.

Thus, methods have been developed which are used to identify and correct the source of problems in the TTS voices to improve speech quality. These are typically iterative methods that consist of synthesizing sample text and correcting the problems found.

The process for correcting the encountered problems can be very cumbersome. For example, one must first identify the time offset where the speech defect occurs in the synthesized audio. Once the location of the problem has been determined, the TTS engine generated log file can be searched to identify the phonetic unit that was used to generate the speech at the specific time offset. From the phonetic unit identifier obtained from this log file, one can determine which recording contains this segment. By consulting the phonetic alignment files, the location of the phonetic unit within the actual recording also can be determined.

At this point, the recording containing this problematic audio segment can be displayed using an appropriate audio editing application. For instance, a user can first launch the audio editing application and then load the appropriate file. The defective audio segment at the location obtained from the phonetic alignment files can then be analyzed. If the audio editing application supports the display of labels, labels such as phonetic labels, voicing labels, and the like can be displayed, depending on the nature of the problem. If a correction to the TTS voice is required, accessing, searching and editing additional data files may be required.

It should be appreciated that identifying and correcting the source of problems in synthesized speech using the method described above is very laborious, tedious and inefficient. Thus, what is needed is a method of simplifying the debugging and tuning process so that this process can be performed much more quickly and with fewer steps.

SUMMARY OF THE INVENTION

The invention disclosed herein provides a method, a system, and an apparatus for identifying and correcting sources of problems in synthesized speech which is generated using a concatenative text-to-speech (CTTS) technique. The application provides modules and tools which can be used to quickly identify problem audio segments and edit parameters associated with the audio segments. Voice configuration files and text-to-speech (TTS) segment datasets having parameters associated with the problem audio segments can be automatically presented within a graphical user interface for editing.

The method can include the step of displaying a waveform corresponding to synthesized speech generated from concatenated phonetic units. The synthesized speech can be generated from text input received from a user. The method further can include the step of, responsive to a user input selection, automatically displaying parameters associated with at least one of the phonetic units that correlate to the selected portion of the waveform. In addition, the recording containing the phonetic unit can be displayed and played through the built-in audio player. An editing input can be received from the user and the parameters can be adjusted in accordance with the editing input.

The edited parameters can be contained in a text-to-speech engine configuration file and can include speaking rate, base pitch, volume, and/or cost function weights. The edited parameters also can be parameters contained in a segment dataset. Such parameters can include phonetic unit labeling, phonetic unit boundaries, and pitch marks. Such parameters also can be adjusted in the segment dataset. For example, pitch marks can be deleted, inserted or repositioned. Further, phonetic alignment boundaries can be adjusted and phonetic labels can be modified.

BRIEF DESCRIPTION OF THE DRAWINGS

There are shown in the drawings, embodiments which are presently preferred, it being understood, however, that the invention is not limited to the precise arrangements and instrumentalities shown.

DETAILED DESCRIPTION OF THE INVENTION

The invention disclosed herein provides a method, a system, and an apparatus for identifying and correcting sources of problems in synthesized speech which is generated using a concatenative text-to-speech (CTTS) technique. In particular, the application provides modules and tools which can be used to quickly identify problem audio segments and edit parameters associated with the audio segments. For example, such problem identification and parameter editing can be performed using a graphical user interface (GUI). In particular, voice configuration files containing general voice parameters and text-to-speech (TTS) segment datasets having parameters associated with the problem audio segments can be automatically presented within the GUI for editing. In comparison to traditional methods of identifying and correcting synthesized audio segments, the present method is much more efficient and less tedious.

Figure 1:
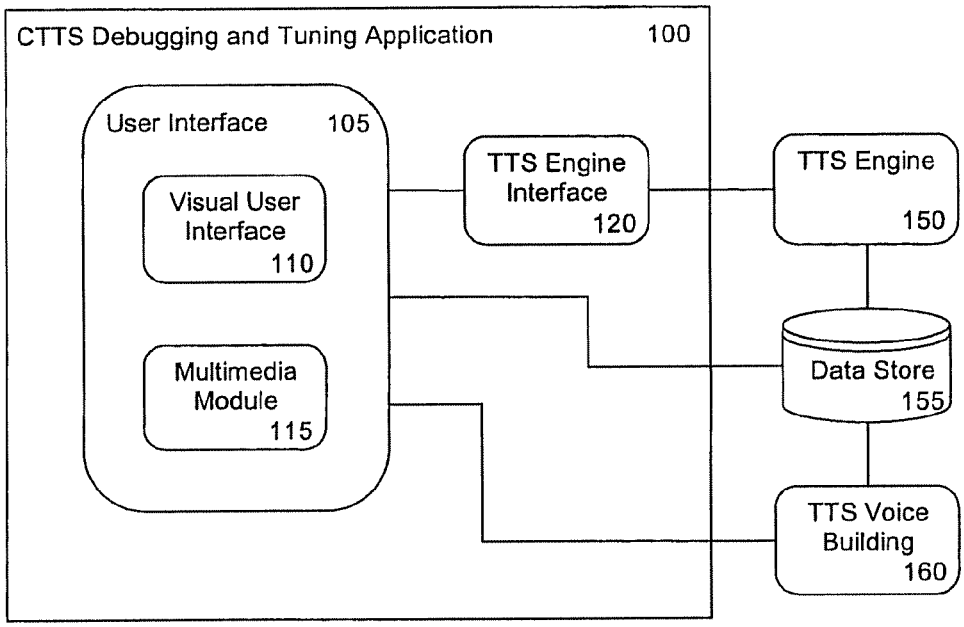
FIG. 1 is a schematic diagram of a system which is useful for understanding the present invention.

A schematic diagram of a system including a CTTS debugging and tuning application (application) 100 which is useful for understanding the present invention is shown in FIG. 1. The application 100 can include a TTS engine interface 120 and a user interface 105. The user interface 105 can comprise a visual user interface 110 and a multimedia module 115.

The TTS engine interface 120 can handle all communications between the application 100 and a TTS engine 150. In particular, the TTS engine interface 120 can send action requests to the TTS engine 150, and receive results from the TTS engine 150. For example, the TTS engine interface 120 can receive a text input from the user interface 105 and provide the text input to the TTS engine 150. The TTS engine 150 can search the CTTS voice located on a data store 155 to identify and select phonetic units which can be concatenated to generate synthesized audio correlating to the input text. A phonetic unit can be a recording of a speech segment, such as a phoneme, a sub-phoneme, an allophone, a syllable, a word, a portion of a word, or a plurality of words.

In addition to selecting phonetic units to be concatenated, the TTS engine 150 also can splice segments, and determine the pitch contour and duration of the segments. Further, the TTS engine 150 can generate log files identifying the phonetic units used in synthesis. The log files also can contain other related information, such as phonetic unit labeling information, prosodic target values, as well as each phonetic unit's pitch and duration.

The multimedia module 115 can provide an audio interface between a user and the application 100. For instance, the multimedia module 115 can receive digital speech data from the TTS engine interface 120 and generate an audio output to be played by one or more transducive elements. The audio signals can be forwarded to one or more audio transducers, such as speakers.

Figure 2:
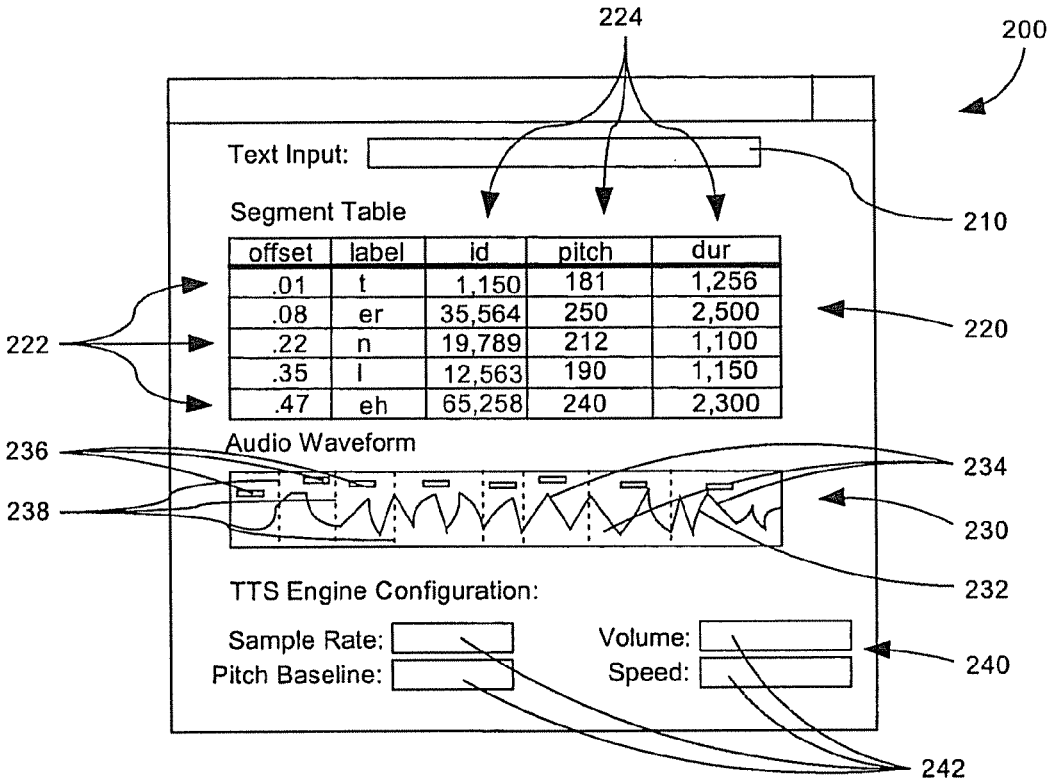
FIG. 2 is a diagram of a graphical user interface screen which is useful for understanding the present invention.

The visual user interface 110 can be a graphical user interface (GUI). The GUI can comprise one or more screens. A diagram of an exemplary GUI screen 200 which is useful for understanding the present invention is depicted in FIG. 2. The screen 200 can include a text input section 210, a speech segment table display section 220, an audio waveform display 230, and a TTS engine configuration section 240. In operation, a user can use the text input section 210 to enter text that is to be synthesized into speech. The entered text can be forwarded via the TTS engine interface 120 to the TTS engine 150. The TTS engine 150 can identify and select the appropriate phonetic units from the CTTS voice to generate audio data for synthesizing the speech. The audio data can be forwarded to the multimedia module 115, which can audibly present the synthesized speech. Further, the TTS engine 150 also generates a log file comprising a listing of the phonetic units and associated TTS engine parameters.

When generating the audio data, the TTS engine 150 can utilize a TTS configuration file. The TTS configuration file can contain configuration parameters which are useful for optimizing TTS engine processing to achieve a desired synthesized speech quality for the audio data. The TTS engine configuration section 240 can present adjustable and non-adjustable configuration parameters. The configuration parameters can include, for instance, parameters such as language, sample rate, pitch baseline, pitch fluctuation, volume and speed. It can also include weights for adjusting the search cost functions, such as the pitch cost weight and the duration cost weight. Nonetheless, the present invention is not so limited and any other configuration parameters can be included in the TTS configuration file.

Within the TTS engine configuration section 240, the configuration parameters can be presented in an editable format. For example, the configuration parameters can be presented in text boxes 242 or selection boxes. Accordingly, the adjustable configuration parameters can be changed merely by editing the text of the parameters within the text boxes, or by selecting new values from ranges of values presented in drop down menus associated with the selection boxes. As the configuration parameters are changed in the text boxes 242, the TTS engine configuration file can be updated.

Parameters associated with the phonetic units used in the speech synthesis can be presented to the user in the speech segment table section 220, and a waveform of the synthesized speech can be presented in the audio waveform display 230. The segment table section 220 can include records 222 which correlate to the phonetic units selected to generate speech. In a preferred arrangement, the records 222 can be presented in an order commensurate with the playback order of the phonetic units with which the records 222 are associated. Each record can include one or more fields 224. The fields 224 can include phonetic labeling information, boundary locations, target prosodic values, and the actual prosodic values for the selected phonetic units. For example, each record can include a timing offset which identifies the location of the phonetic unit in the synthesized speech, a label which identifies the phonetic unit, for example by the type of sound associated with the phonetic unit, an occurrence identification which identifies the specific instance of the phonetic unit within the CTTS voice, a pitch frequency for the phonetic unit, and a duration of the phonetic unit.

As noted, the audio waveform display 230 can display an audio waveform 232 of the synthetic speech. The waveform can include a plurality of sections 234, each section 234 correlating to a phonetic unit selected by the TTS engine 150 for generating the synthesized speech. As with the records 222 in the segment table section 220, the sections 234 can be presented in an order commensurate with the playback order of the phonetic units with which the sections 234 are associated. Notably, a one to one correlation can be established between each section 234 and a correlating record 222 in the segment table 220.

Phonetic unit labels 236 can be presented in each section 234 to identify the phonetic units associated with the sections 234. Section markers 238 can mark boundaries between sections 234, thereby identifying the beginning and end of each section 234 and constituent phonetic unit of the speech waveform 232. The phonetic unit labels 236 are equivalent to labels identifying correlating records 222. When one or more particular sections 234 are selected, for example using a cursor, correlating records 222 in the segment table section 220 can be automatically selected. Similarly, when one or more particular records 222 are selected, their correlating sections 234 can be automatically selected. A visual indicator can be provided to notify a user which record 222 and section 234 have been selected. For example, the selected record 222 and section 234 can be highlighted.

Figure 3:
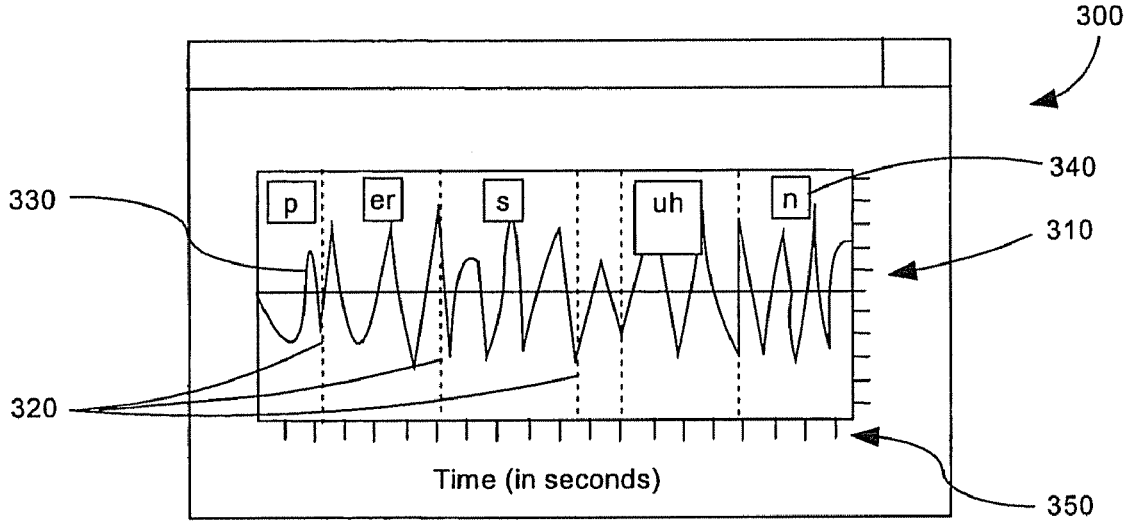
FIG. 3 is a diagram of another graphical user interface screen which is useful for understanding the present invention.

One or more additional GUI screens can be provided for editing the parameters associated with the selected phonetic units. An exemplary GUI screen 300 that can be used to display the recording containing a selected phonetic unit and to edit the phonetic unit data obtained from the recording is depicted in FIG. 3. The screen 300 can present parameters associated with a phonetic unit currently selected in the segment table display section 220 or a selected section 234 of the audio waveform 232. The screen 300 can be activated in any manner. For example the screen 300 can be activated using a selection method, such as a switch, an icon or button. In another arrangement, the screen 300 can be activated by using a second record 222 selection method or a second section 234 selection method. For example, the second selection methods can be cursor activated, for instance by placing a cursor over the desired record 222 or section 234 and double clicking a mouse button, or highlighting the desired record 222 or section 234 and depressing an enter key on a keyboard.

The screen 300 can include a waveform display 310 of the recording containing the selected phonetic unit. Boundary markers 320 representing the phonetic alignments of the phonetic units in the recording can be overlaid onto the waveform 330. Labels of the phonetic units 340 can be presented in a modifiable format. For example, the position of the boundary markers 320 can be adjusted to change the phonetic alignments. Further, the label of any phonetic unit in the recording can be edited by modifying the text in the displayed labels 340 of the waveform 330. In addition, screen 300 may also be used to display pitch marks. Markers representing the location of the pitch marks can be overlaid onto the waveform 330. These markers can be repositioned or deleted. New markers may also be inserted. The screen 300 can be closed after the phonetic alignment, phonetic labels and pitch mark edits are complete. The CTTS voice is automatically rebuilt with the user's corrections.

Referring again to FIG. 2, after editing of the TTS configuration file and/or the segment dataset within the CTTS voice, a user can enter a command which causes the TTS engine 150 to generate a new set of audio data for the input text. For example, an icon can be selected to begin the speech synthesizing process. An updated audio waveform 232 incorporating the updated phonetic unit characterizations can be displayed in the audio waveform display 230. The user can continue editing the TTS configuration file and/or phonetic unit parameters until the synthesized speech generated from a particular input text is produced with a desired speech quality.

Figure 4:
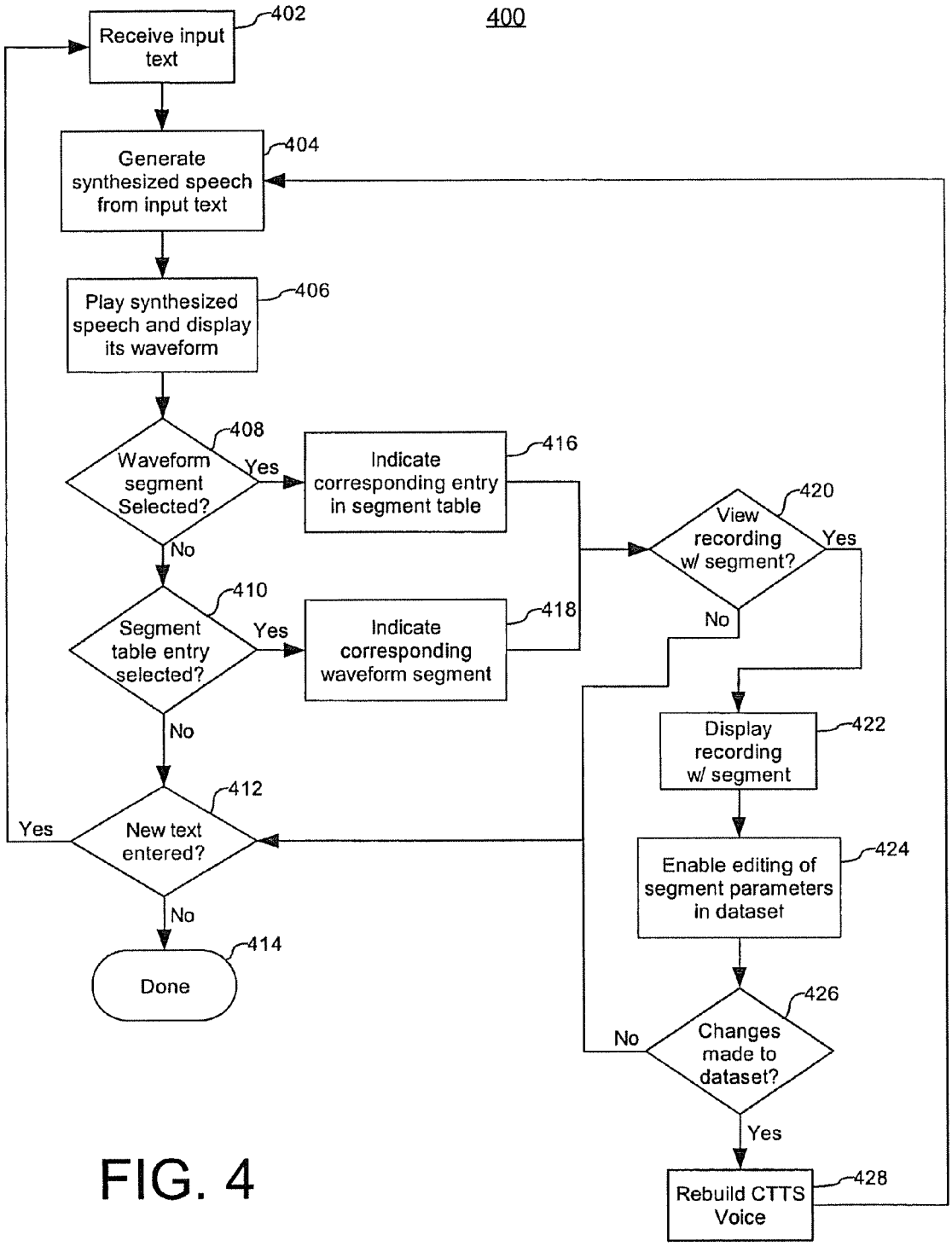
FIG. 4 is a flowchart which is useful for understanding the present invention.

Referring to FIG. 4, a flow chart 400 which is useful for understanding the present invention is shown. Beginning at step 402, an input text can be received from a user. Referring to step 404, synthesized speech can be generated from the input text. Continuing to step 406, the synthesized speech then can be played back to the user, for instance through audio transducers, and a waveform of the synthesized speech can be presented, for example in a display. The user can select a portion of the waveform or the entire waveform, as shown in decision box 408, or a segment table entry correlating to the waveform can be selected, as shown in decision box 410. If neither a portion of the waveform or the entire waveform or correlating segment table entries are selected, for example when a user is satisfied with the speech synthesis of the entered text, the user can enter new text to be synthesized, as shown in decision box 412 and step 402, or the user can end the process, as shown in step 414.

Referring again to decision box 408 and to step 416, if a user has selected a waveform segment, a corresponding entry in the segment table can be indicated, as shown in step 416. For example, the record of the phonetic units correlating to the selected waveform segment can be highlighted. Similarly, if a segment table entry is selected, the corresponding waveform segments can be indicated, as shown in decision box 410 and step 418. For instance, the waveform segment can be highlighted or enhanced cursors can mark the beginning and end of the waveform segment. Proceeding to decision box 420, a user can choose to view an original recording containing the segment correlating to the selected segment table entry/waveform segment. If the user does not select this option, the user can enter new text, as shown in decision box 412 and step 402, or end the process as shown in step 414.

If, however, the user chooses to view the original recording containing the segment, the recording can be displayed, for example on a new screen or window which is presented, as shown in step 422. Continuing to step 424, the recording's segment parameters, such as label and boundary information, can be edited. Proceeding to decision box 426, if changes are not made to the parameters in the segment dataset, the user can close the new screen and enter new text for speech synthesis, or end the process. If changes are made to the parameters in the segment dataset, however, the CTTS voice can be rebuilt using the updated parameters, as shown in step 428. A new synthesized speech waveform then can be generated for the input text using the new rebuilt CTTS voice, as shown in step 404. The editing process can continue as desired.

The present method is only one example that is useful for understanding the present invention. For example, in other arrangements, a user can make changes in each GUI portion after step 406, step 408, step 410, or step 424. Moreover, different GUI's can be presented to the user. For example, the waveform display 310 can be presented to the user within the GUI screen 200. Still, other GUI arrangements can be used, and the invention is not so limited.

The present invention can be realized in hardware, software, or a combination of hardware and software. The present invention can be realized in a centralized fashion in one computer, or in a distributed fashion where different elements are spread across several interconnected computer systems. Any kind of computer system or other apparatus adapted for carrying out the methods described herein is suited. A typical combination of hardware and software can be a general purpose computer system with a computer program that, when being loaded and executed, controls the computer system such that it carries out the methods described herein.

The present invention also can be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

This invention can be embodied in other forms without departing from the spirit or essential attributes thereof. Accordingly, reference should be made to the following claims, rather than to the foregoing specification, as indicating the scope of the invention.

What is claimed is:

1. A system for debugging and tuning synthesized audio, comprising:

means for receiving a user-supplied text with a visual user interface;

means for generating synthesized audio generated from concatenated phonetic units, the synthesized audio being a voice rendering of the user-supplied text;

means for displaying the waveform corresponding to synthesized audio generated from concatenated phonetic units;

means for displaying parameters corresponding to at least one of the phonetic units, the parameters including configuration parameters comprising at least one weight for adjusting at least one search cost function, the at least one weight comprising at least one of a pitch cost weight and a duration cost weight;

means for displaying an original recording containing a selected phonetic unit;

means for receiving an editing input from the user; and means for adjusting the parameters in accordance with the editing input by adjusting and storing in a text-to-speech engine configuration file at least one configuration parameter, wherein adjusting includes repositioning a phonetic alignment marker;

means for highlighting in the display of the original recording at least one user-selected phonetic unit;

means for correcting elements of a text-to-speech segment dataset of parameters corresponding to a segment of the synthesized audio identified as being problematic;

means for generating a new synthesized waveform corresponding to one or more adjusted parameters; and wherein the system continues to regenerate new synthesized waveforms until a desired synthesized output is generated.

2. A machine-readable storage having stored thereon a computer program having a plurality of code sections, the code sections executable by a machine for causing the machine to perform the steps of:

(a) receiving a user-supplied text with a visual user interface;

(b) generating synthesized audio generated from concatenated phonetic units, the synthesized audio being a voice rendering of the user-supplied text;

(c) displaying a waveform corresponding to the synthesized audio generated from concatenated phonetic units;

(d) displaying parameters corresponding to at least one of the phonetic units, the parameters including configuration parameters comprising at least one weight for adjusting at least one search cost function, the at least one weight comprising at least one of a pitch cost weight and a duration cost weight;

(e) displaying an original recording containing a selected phonetic unit;

(f) receiving an editing input from the user;

(g) adjusting at least one configuration parameter in accordance with the editing input and storing the at least one configuration parameter in a text-to-speech engine configuration file, wherein adjusting includes repositioning a phonetic alignment marker;

(h) highlighting in the display of the original recording at least one user-selected phonetic unit;

(i) correcting elements of a text-to-speech segment dataset of parameters corresponding to a segment of the synthesized audio identified as being problematic;

(j) generating a new synthesized waveform corresponding to one or more adjusted parameters; and (k) repeating steps (b)-(j) until a desired synthesized output is generated.

3. The machine-readable storage of claim 2, wherein said displaying parameters step further comprises displaying the parameters responsive to a user selection of at least a portion of the waveform, the displayed parameters correlating to the selected portion of the waveform.

4. The machine-readable storage of claim 2, wherein said displaying parameters step further comprises identifying a portion of the waveform responsive to a user selection of at least one of the parameters, the identified portion of the waveform correlating to the selected parameters.

5. The machine-readable storage of claim 2, wherein said adjusting step comprises at least one action selected from the group consisting of deleting a pitch mark, inserting a pitch mark, and repositioning a pitch mark by deleting a phonetic unit label, adding a phonetic unit label, modifying the phonetic unit label, and repositioning the phonetic unit boundaries.

6. The machine-readable storage of claim 2, wherein said displaying parameters step further comprises the step of displaying a waveform from the original recording along with the phonetic unit.

7. The machine-readable storage of claim 6, wherein edits to the waveform adjust parameters in the segment dataset.

* * * * *

UNITED STATES PATENT AND TRADEMARK OFFICE

CERTIFICATE OF CORRECTION

PATENT NO. : 7,853,452 B2
APPLICATION NO. : 12/327579
DATED : December 14, 2010
INVENTOR(S) : Philip Gleason et al.

It is certified that error appears in the above-identified patent and that said Letters Patent is hereby corrected as shown below:

On the Title Pg, Item (54) and Col. 1 lines 1-2
Please correct the title of the invention to the following:

AN INTERACTIVE DEBUGGING AND TUNING METHOD FOR CTTS VOICE BUILDING

Signed and Sealed this
Fifteenth Day of February, 2011

David J. Kappos

David J. Kappos
*Director of the United States Patent and Trademark Office*